US008248443B2

(12) United States Patent
Minarelli et al.

(10) Patent No.: US 8,248,443 B2
(45) Date of Patent: Aug. 21, 2012

(54) LASER PACKET MARKING UNIT

(75) Inventors: Alessandro Minarelli, Bazzano (IT); Gaetano De Pietra, Casalecchio Di Reno (IT); Massimo Bichicchi, San Benedetto Val Di Sambro (IT); Luca Cerati, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 420 days.

(21) Appl. No.: 12/571,741

(22) Filed: Oct. 1, 2009

(65) Prior Publication Data

US 2010/0085413 A1 Apr. 8, 2010

(30) Foreign Application Priority Data

Oct. 6, 2008 (IT) ..... BO2008A0604

(51) Int. Cl.
*B41J 2/435* (2006.01)

(52) U.S. Cl. ..... 347/224

(58) Field of Classification Search ..... 347/224, 347/225, 230, 241–244, 256–260; 219/121.6, 219/121.73–121.76, 121.79
See application file for complete search history.

(56) References Cited

U.S. PATENT DOCUMENTS 4,874,919 A * 10/1989 Bransden et al. ..... 219/121.68
6,804,051 B2 * 10/2004 Deverin ..... 359/431
6,961,078 B2 * 11/2005 Yamate et al. ..... 347/241
2004/0101000 A1 * 5/2004 Han et al. ..... 372/22
2005/0134678 A1 6/2005 Franklin et al.

FOREIGN PATENT DOCUMENTS

| | | | |
|---|---|---|---|
| DE | 4237577 | A1 | 5/1993 |
| EP | 1 605 293 | A1 | 12/2005 |
| EP | 1 916 188 | A1 | 4/2008 |
| GB | 2 337 974 | A | 12/1999 |
| WO | WO-92/03297 | A1 | 3/1992 |

OTHER PUBLICATIONS

European Search Report in European Patent Application No. 09172261.1 dated Dec. 11, 2009.

* cited by examiner

*Primary Examiner* — Hai C Pham
(74) *Attorney, Agent, or Firm* — Marshall, Gerstein & Borun LLP

(57) ABSTRACT

A laser marking unit for marking packets, having: a marking conveyor for feeding the packets successively along a marking path; and a marking station located along the marking conveyor, and having a laser marking device for marking a code on the outer surface of each packet conveyed on the marking conveyor. The laser marking device has a laser beam generator which emits a laser beam by means of an emitter; and a deflection box which deflects the laser beam onto the packet at the marking station by directing the laser beam along a focusing path that starts at the emitter and terminates on the outer surface of the packet.

11 Claims, 5 Drawing Sheets

LASER PACKET MARKING UNIT

CROSS-REFERENCE TO RELATED APPLICATIONS

This application claims the benefit of Italian patent application No. BO 2008A 000604, filed Oct. 6, 2008.

TECHNICAL FIELD

The present invention relates to a laser packet marking unit.

The present invention may be used to advantage for marking progressive alphanumeric codes on the outer surface of packets of cigarettes, to which the following description refers purely by way of example.

BACKGROUND ART

On some packing lines for manufacturing packets of cigarettes, each packet produced must be marked or punched or printed with a progressive code indicating, for example, the date and/or place of manufacture.

U.S. Pat. No. 6,098,533A1 describes a conveyor for stabilizing packets of cigarettes coming off a packing machine, and on which each packet is fed along a stabilizing path and through a marking station by two opposite, facing conveyor belts, which partly engage respective opposite minor lateral surfaces of the packet; and a laser marking device at the marking station marks a progressive code on a portion of one of the minor lateral surfaces of the packet left exposed by the respective conveyor belt.

Patent Application US2001032932A1 describes the laser marking of a progressive code on the outer surface of packets of cigarettes. The packets of cigarettes are fed forward on a conveyor (preferably a vertical drying drum) fitted with grippers, which engage each packet of cigarettes, leaving exposed a marking area of the packet, on which a laser marking device, connected to the conveyor, marks the progressive code.

Patent Application EP1916188A1 describes a packet marking unit comprising: a marking conveyor for feeding the packets successively along a marking path and having a number of pockets, each for housing a respective packet; an input station; an output station; and a marking station located along the marking conveyor, between the input station and the output station, and having a laser marking device for marking a code on the outer surface of each packet on the marking conveyor.

Depending on the type of packet of cigarettes, the progressive code must be marked on an end wall or a lateral wall of each packet. In the above known laser marking units, switching the marking area from the end to the side of the packet (or vice versa) calls for changing the position of the laser marking device with respect to the conveyor feeding the packets past the device. This is due to the fact that, under current safety regulations (i.e. to reduce harm in the event of accidental contact with the laser beam), the focal area of the laser beam is very small, which means the path of the laser beam from the laser marking device emitter to the surface of the packet must always equal a given, non-adjustable distance. In other words, to switch the marking area from the end to the side of the packet (or vice versa), the position of the laser marking device with respect to the packet conveyor must be changed so that the path of the laser beam from the laser marking device emitter to the surface of the packet is always the same length.

Changing the position of the laser marking device with respect to the packet conveyor is a fairly complicated, time-consuming job, on account of the considerable size of the device and its location in an area crowded with other components, and what is more takes at least two operators, on account of the considerable weight of the device.

DISCLOSURE OF THE INVENTION

It is an object of the present invention to provide a laser packet marking unit designed to eliminate the aforementioned drawbacks, and which at the same time is cheap and easy to produce.

According to the present invention, there is provided a laser packet marking unit as claimed in the attached Claims.

BRIEF DESCRIPTION OF THE DRAWINGS

A non-limiting embodiment of the present invention will be described by way of example with reference to the accompanying drawings, in which.

PREFERRED EMBODIMENTS OF THE INVENTION

Figure 1:
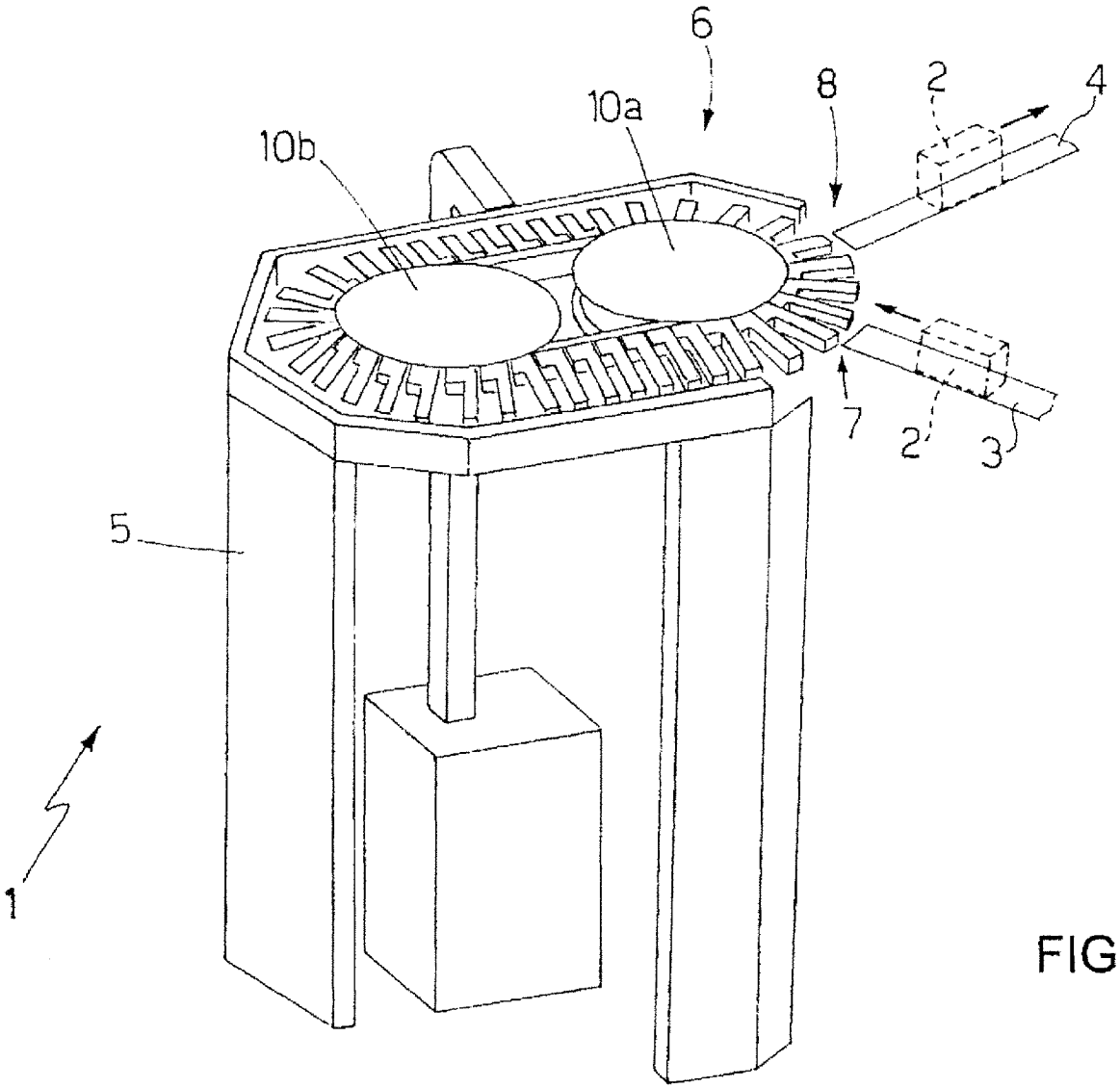
FIG. 1 shows a schematic view in perspective, with parts removed for clarity, of a laser marking unit, for marking packets of cigarettes, in accordance with the present invention.

Number 1 in FIG. 1 indicates as a whole a marking unit for marking a progressive code (normally an alphanumeric and/or bar code) on the outer surface of packets 2 of cigarettes. The marking unit 1 shown in FIG. 1 is very similar to the one described in Patent Application EP1916188A1, which is included herein by way of reference. Packets 2 of cigarettes are fed to marking unit 1 on an input belt conveyor 3, which receives a succession of packets 2 of cigarettes, arranged in single file, from a packing machine (not shown); and from marking unit 1, packets 2 of cigarettes are fed onto an output belt conveyor 4, which feeds a succession of packets 2 of cigarettes, arranged in single file, to a cellophaning machine (not shown).

Marking unit 1 comprises a frame 5 resting on feet on the floor and supporting a horizontal marking conveyor 6, which feeds packets 2 of cigarettes along a marking path P extending between an input station 7 at the output end of input conveyor 3, and an output station 8 at the input end of output conveyor 4.

Figure 2:
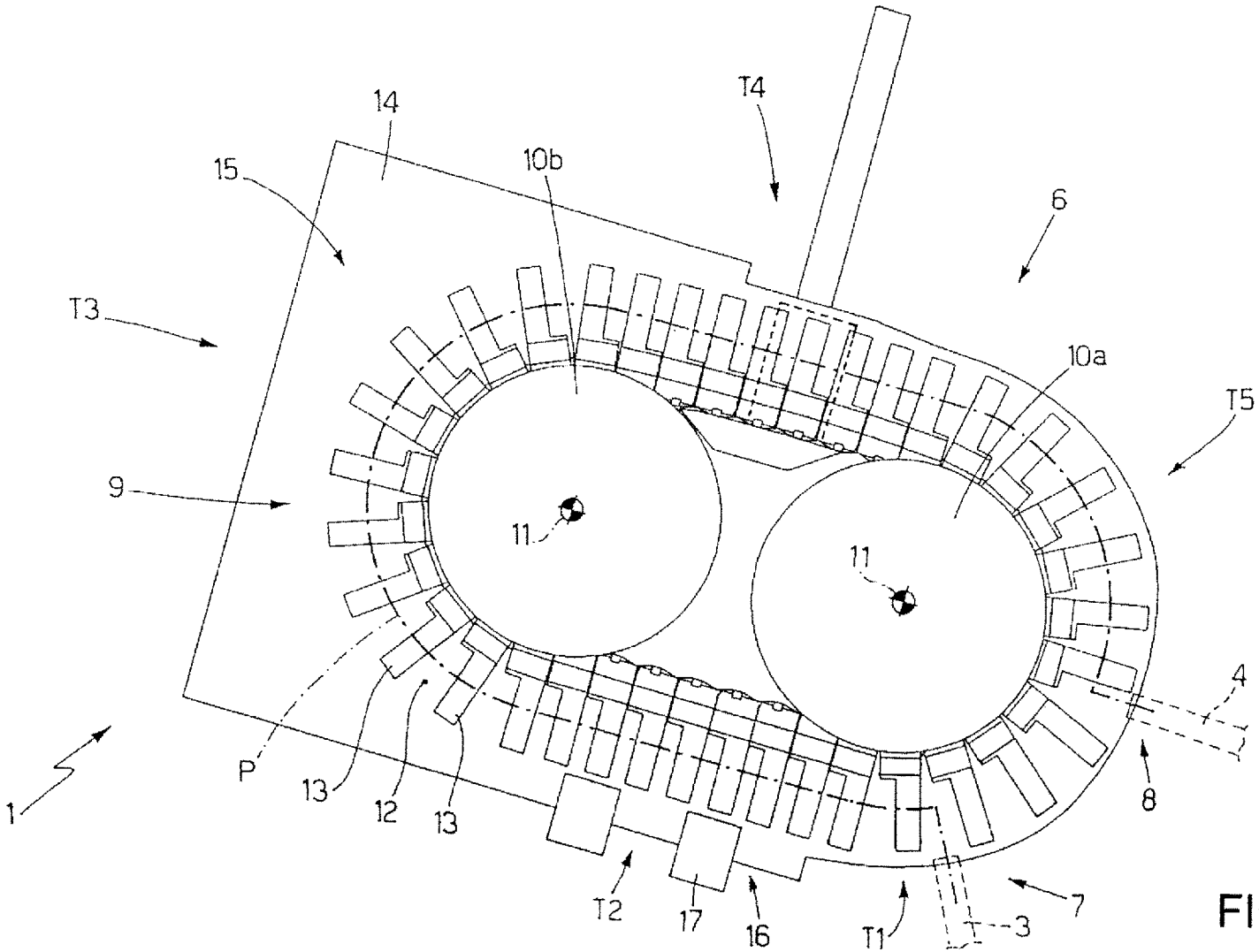
FIG. 2 shows a plan view, with parts removed for clarity, of the FIG. 1 laser marking unit.

As shown in FIG. 2, marking conveyor 6 comprises an endless belt 9 looped about two horizontal end pulleys 10*a*, 10*b* mounted to rotate about respective vertical central axes of rotation 11. Preferably, one end pulley 10 is powered to rotate continuously about respective central axis of rotation 11, while the other pulley 10 is idle. Consequently, path P comprises a curved, arc-shaped initial portion T1 extending about end pulley 10*a*; a straight intermediate portion T2 extending between end pulleys 10*a* and 10*b*; a curved, semicircular intermediate portion T3 extending about end pulley 10*b*; a straight intermediate portion T4 extending between end pulleys 10*b* and 10*a*; and a curved, arc-shaped end portion T5 extending about end pulley 10*a*.

A number of pockets 12 are defined along belt 9, each for housing a respective packet 2 of cigarettes. More specifically, each pocket 12 receives a respective packet 2 of cigarettes from input conveyor 3 at input station 7, and releases respective packet 2 of cigarettes to output conveyor 4 at output station 8. Belt 9 supports a number of grippers 13, each perpendicular to belt 9 and defining a wall of a respective pocket 12. In other words, each pocket 12 is defined and bounded by two consecutive, side by side grippers 13.

In a preferred embodiment, marking conveyor 6 comprises a support 14 beneath marking conveyor 6 and having a horizontal top wall 15, on which packets 2 of cigarettes slide, pushed along by pockets 12 of marking conveyor 6.

Marking unit 1 also comprises a marking station 16 located along marking conveyor 6, between input station 7 and output station 8, and in particular along straight intermediate portion T2 of marking path P, between end pulley 10*a* and end pulley 10*b*. Marking station 16 comprises a laser marking device 17 for marking a code on the outer surface of each packet 2 of cigarettes on marking conveyor 6.

Figure 3:
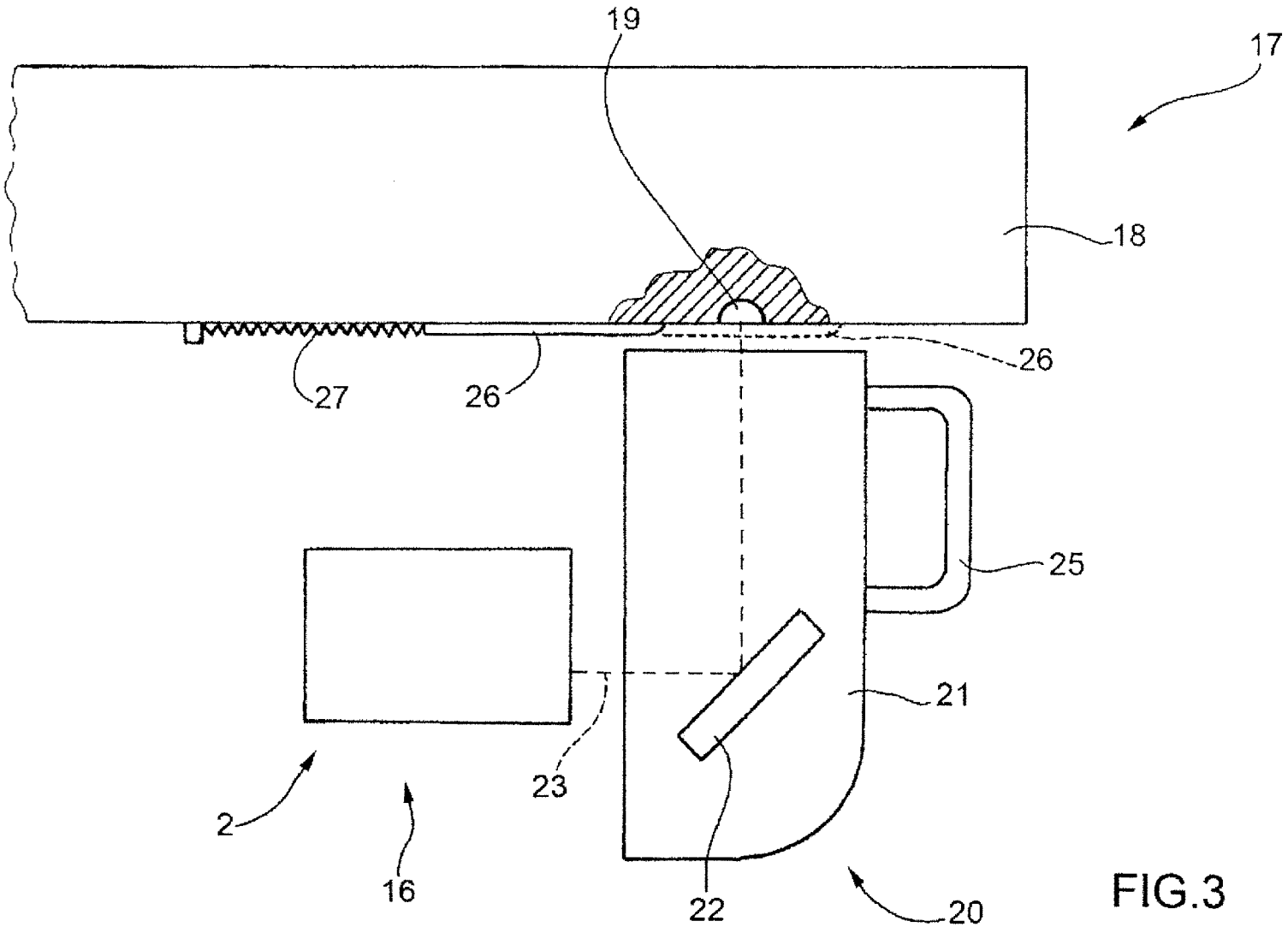
FIG. 3 shows a schematic side view, with parts removed for clarity, of a laser marking device of the FIG. 1 laser marking unit.

As shown in FIG. 3, laser marking device 17 comprises a laser beam generator 18 for emitting a laser beam by means of an emitter 19; and a deflection box 20 connected mechanically to generator 18 to deflect the laser beam onto the packet 2 of cigarettes at (i.e. travelling through) marking station 16, to mark the progressive code on the outer surface of packet 2 of cigarettes.

Deflection box 20 comprises a supporting box 21 housing a number of mirrors 22 for deflecting the laser beam. In a preferred embodiment, each mirror 22 is defined by a circular plate of mirror-polished copper and fixed inside box 21 by respective screws. More specifically, mirrors 22 of deflection box 20 define a focusing path 23, along which the laser beam travels in use, and which starts at emitter 19, and ends on the outer surface of the packet 2 of cigarettes at marking station 16. Deflection box 20 is connected mechanically to laser beam generator 18 for easy removal and replacement.

Figure 4:
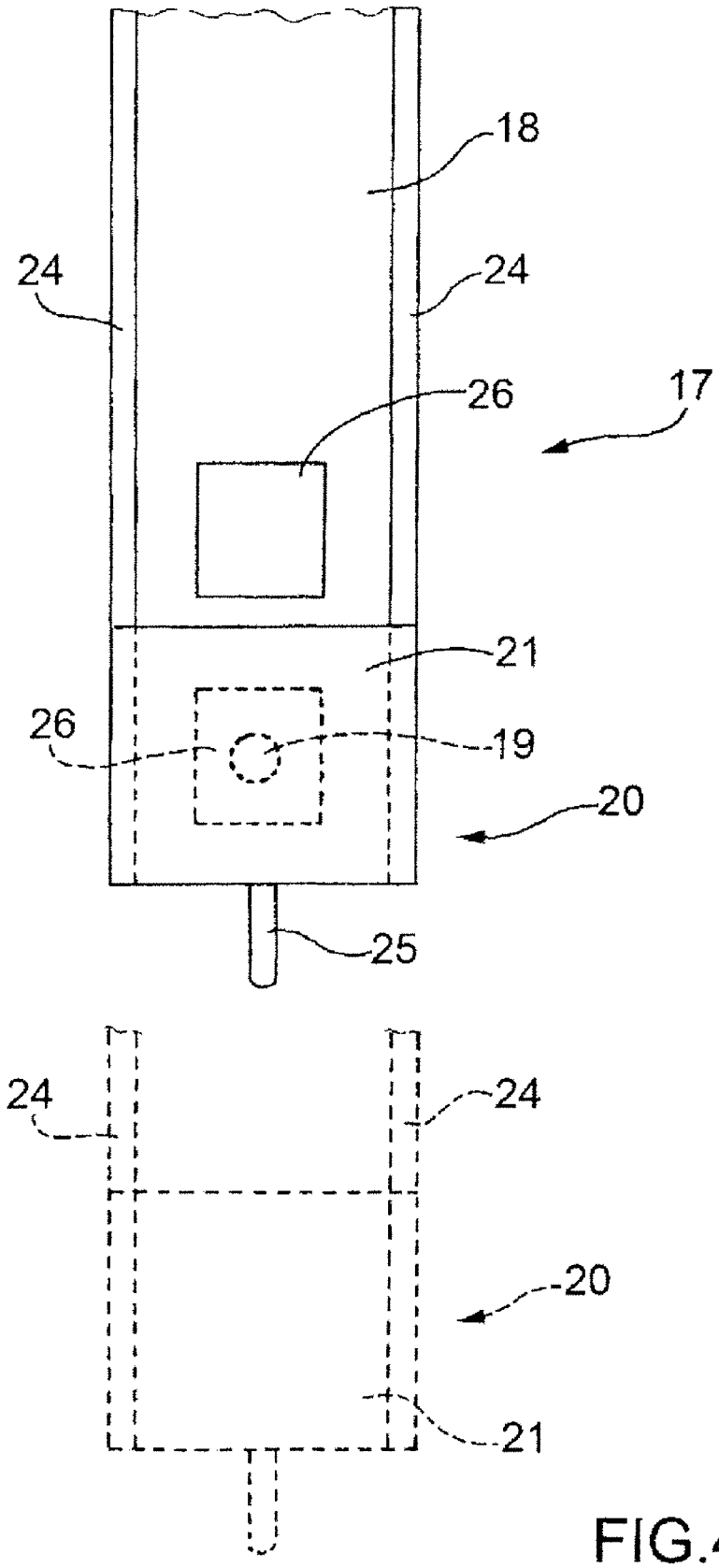
FIG. 4 shows a schematic underside view, with parts removed for clarity, of the laser marking device in FIG. 3.

In a preferred embodiment shown in FIG. 4, deflection box 20 is screwed to two telescopic guides 24, which slide between a work position (shown by the continuous line in FIG. 4), in which deflection box 20 is connected to laser beam generator 18 at emitter 19, and a change position (shown partly by the dash line in FIG. 4), in which deflection box 20 is detached a fair distance from laser beam generator 18 and substantially free on all sides. Telescopic guides 24 serve to move deflection box 20 quickly and easily into the change position, in which deflection box 20 is free on all sides and therefore quickly and easily replaceable. Deflection box 20 is preferably fitted with a handle 25, by which to move deflection box 20 easily between the work position and the change position.

A preferred embodiment shown in FIGS. 3 and 4 has a safety shutter 26 mounted to slide between an open position (shown by the continuous line in FIGS. 3 and 4), in which safety shutter 26 is moved with respect to emitter 19 to permit emission of the laser beam, and a closed position (shown partly by the dash line in FIGS. 3 and 4), in which safety shutter 26 covers emitter 19 to prevent emission of the laser beam. Shutter 26 is fitted with an elastic body (typically a spring) to push shutter 26 into the closed position, and is connected mechanically to telescopic guides 24 so that, in the work position, telescopic guides 24 push shutter 26 into the open position in opposition to elastic body 27, and, when telescopic guides 24 are in the change position, shutter 26 is moved freely into the closed position by elastic body 27.

Figure 6:
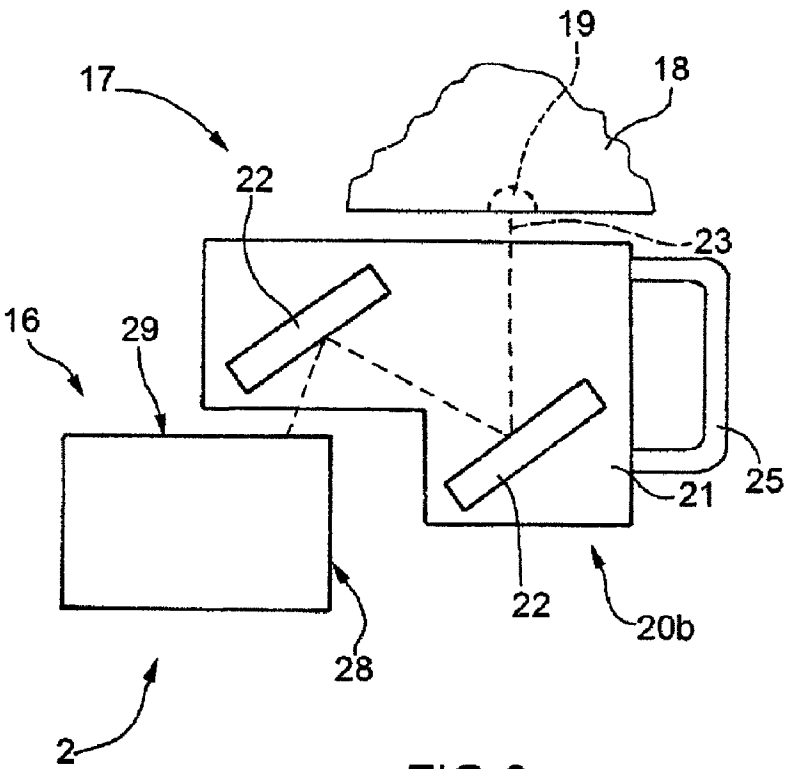
FIGS. 5 and 6 show schematics of two deflection boxes of the FIG. 3 laser marking device.
Figure 5:
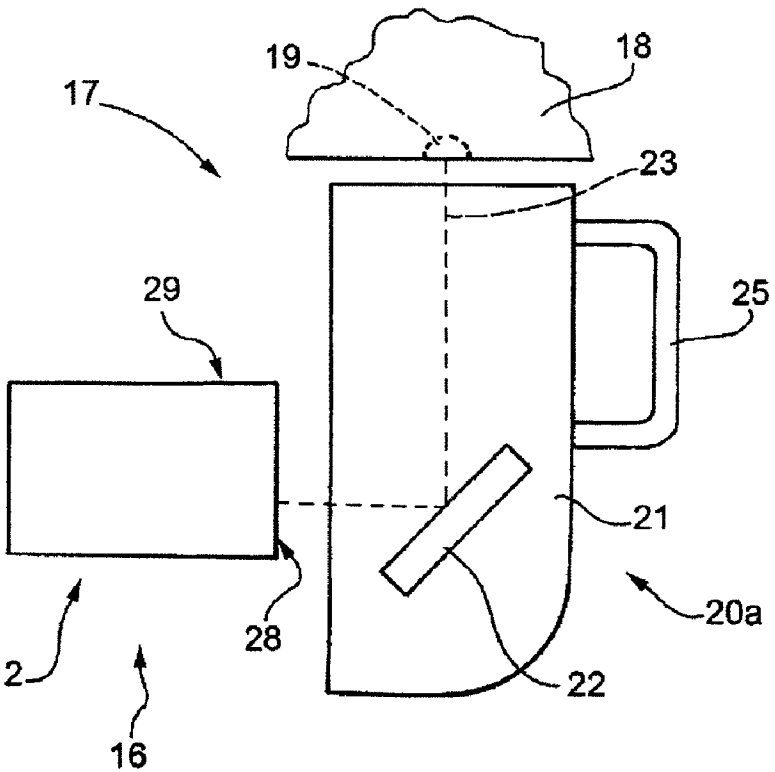

As shown in FIGS. 5 and 6, at least two different, interchangeable deflection boxes 20*a* and 20*b* are provided: deflection box 20*a* is designed to mark a progressive code on an end wall 28 of a packet 2 of cigarettes moving through marking station 16 on marking conveyor 6; and deflection box 20*b* is designed to mark a progressive code on a lateral wall 29 (perpendicular and adjacent to end wall 28) of a packet 2 of cigarettes moving through marking station 16 on marking conveyor 6. More specifically, deflection box 20*a* comprises one mirror 22, while deflection box 20*b* comprises two mirrors 22. A particular feature of deflection boxes 20*a* and 20*b* is that, in both cases, the respective focusing paths 23 are exactly the same length and equal to the focal length of laser beam generator 18. That is, in both deflection boxes 20*a* and 20*b*, the distance travelled in use by the laser beam from emitter 19 to the outer surface of packet 2 of cigarettes at marking station 16 is identical and equal to the focal length of laser beam generator 18. Consequently, regardless of which deflection box 20 is fitted to laser beam generator 18, the laser beam is perfectly focused on the outer surface of packet 2 of cigarettes at marking station 16.

By way of example, FIGS. 5 and 6 show two different deflection boxes 20*a* and 20*b*. A larger number of deflection boxes 20, however, may obviously be provided to accordingly increase the number of marking locations on packets 2 of cigarettes.

Laser marking unit 1 as described above has numerous advantages, by being cheap and easy to produce and, above all, by enabling fast, easy alteration to the marking location on packets 2 of cigarettes. More specifically, one operator need simply remove the deflection box 20 currently fitted to laser beam generator 18, and replace it with another deflection box 20 to alter the marking location on packets 2 of cigarettes. In this connection, it is important to point out that deflection boxes 20 are compact (a few $dm^3$ in total volume) and lightweight (normally less than 5 kg) enough to be handled easily by one operator, and to be stored easily, even on marking unit 1 itself.

In view of its many advantages, marking unit 1 described above may also be used to advantage for marking codes or similar on packets 2 other than packets 2 of cigarettes, e.g. for marking codes on cartons of cigarettes, on boxes, or on packages of food products.

The invention claimed is:

1. A laser marking unit (1) for marking packets (2), comprising:

a marking conveyor (6) for feeding the packets (2) successively along a marking path (P); and a marking station (16) located along the marking conveyor (6), and comprising a laser marking device (17) for marking a code on the outer surface of each packet (2) conveyed on the marking conveyor (6);

wherein the laser marking device (17) comprises a laser beam generator (18) which emits a laser beam by means of an emitter (19); and a deflection box (20) which deflects the laser beam onto the packet (2) at the marking station (16) by directing the laser beam along a focusing path (23) that starts at the emitter (19) and terminates on the outer surface of the packet (2);

wherein the deflection box (20) is mechanically connected removably, and therefore replaceably, to the generator (18);

wherein at least two different, interchangeable deflection boxes (20*a*, 20*b*) are provided;

wherein in both deflection boxes (20*a*, 20*b*), the corresponding focusing paths (23) are exactly the same length, which equals a focal length of the laser beam generator (18); and wherein a first deflection box (20*a*) marks the progressive code on an end wall (28) of a packet (2) fed through the marking station (16) on the marking conveyor (6), and a second deflection box (20*b*) marks the progressive code on a lateral wall (29) of a packet (2) fed through the marking station (16) on the marking conveyor (6).

2. A marking unit (1) as claimed in claim 1, wherein the first deflection box (20*a*) comprises one minor (22), and the second deflection box (20*b*) comprises two mirrors (22).

3. A marking unit (1) as claimed in claim 1, wherein each deflection box (20) comprises a supporting body (21) housing a number of minors (22) for deflecting the laser beam.

4. A marking unit (1) as claimed in claim 1, and comprising at least one telescopic guide (24) which supports the deflection box (20) mounted on the laser beam generator (18), and is movable between a work position in which the deflection box (20) is connected to the laser beam generator (18) at the emitter (19), and a change position in which the deflection box (20) is disconnected from the laser beam generator (18) and substantially free on all sides.

5. A marking unit (1) as claimed in claim 4, and comprising a safety shutter (26) which is mounted to move between an open position in which the safety shutter (26) is shifted with respect to the emitter (19) to permit emission of the laser beam, and a closed position in which the safety shutter (26) covers the emitter (19) to prevent emission of the laser beam.

6. A marking unit (1) as claimed in claim 5, wherein the safety shutter (26) is fitted with an elastic body (27) which pushes the safety shutter (26) into the closed position.

7. A marking unit (1) as claimed in claim 6, wherein the safety shutter (26) is connected mechanically to the at least one telescopic guide (24) so that the at least one telescopic guide (24) in the work position pushes the safety shutter (26) into the open position in opposition to the elastic body (27), and, when the at least one telescopic guide (24) is in the change position, the safety shutter (26) is moved freely into the closed position by the elastic body (27).

8. A laser marking unit (1) for marking packets (2), comprising:

a marking conveyor (6) for feeding the packets (2) successively along a marking path (P);

a marking station (16) located along the marking conveyor (6), and comprising a laser marking device (17) for marking a code on the outer surface of each packet (2) conveyed on the marking conveyor (6), wherein the laser marking device (17) comprises a laser beam generator (18) which emits a laser beam by means of an emitter (19), and a deflection box (20) which deflects the laser beam onto the packet (2) at the marking station (16) by directing the laser beam along a focusing path (23) that starts at the emitter (19) and terminates on the outer surface of the packet (2), wherein the deflection box (20) is mechanically connected removably, and therefore replaceably, to the generator (18), wherein at least two different, interchangeable deflection boxes (20*a*, 20*b*) are provided, wherein in both deflection boxes (20*a*, 20*b*), the corresponding focusing paths (23) are exactly the same length, which equals a focal length of the laser beam generator (18); and at least one telescopic guide (24) which supports the deflection box (20) mounted on the laser beam generator (18), and is movable between a work position in which the deflection box (20) is connected to the laser beam generator (18) at the emitter (19), and a change position in which the deflection box (20) is disconnected from the laser beam generator (18) and substantially free on all sides.

9. A marking unit (1) as claimed in claim 8, and comprising a safety shutter (26) which is mounted to move between an open position in which the safety shutter (26) is shifted with respect to the emitter (19) to permit emission of the laser beam, and a closed position in which the safety shutter (26) covers the emitter (19) to prevent emission of the laser beam.

10. A marking unit (1) as claimed in claim 9, wherein the safety shutter (26) is fitted with an elastic body (27) which pushes the safety shutter (26) into the closed position.

11. A marking unit (1) as claimed in claim 10, wherein the safety shutter (26) is connected mechanically to the at least one telescopic guide (24) so that the at least one telescopic guide (24) in the work position pushes the safety shutter (26) into the open position in opposition to the elastic body (27), and, when the at least one telescopic guide (24) is in the change position, the safety shutter (26) is moved freely into the closed position by the elastic body (27).

* * * * *

UNITED STATES PATENT AND TRADEMARK OFFICE

CERTIFICATE OF CORRECTION

PATENT NO. : 8,248,443 B2
APPLICATION NO. : 12/571741
DATED : August 21, 2012
INVENTOR(S) : Minarelli et al.

It is certified that error appears in the above-identified patent and that said Letters Patent is hereby corrected as shown below:

In the Claims

Column 5, Line 8, in Claim 2, delete “minor” and insert -- mirror --, therefor.

Column 5, Line 12, in Claim 3, delete “minors” and insert -- mirrors --, therefor.

Signed and Sealed this
Sixteenth Day of September, 2014

Michelle K. Lee

Michelle K. Lee
*Deputy Director of the United States Patent and Trademark Office*